US005622509A

United States Patent [19]

Smythe et al.

[11] Patent Number: 5,622,509

[45] Date of Patent: Apr. 22, 1997

[54] 3-PRONG ELECTRICAL CONNECTOR

[76] Inventors: Ralph D. Smythe, 2708 Hwy. MN, Cottage Grove, Wis. 53527; Tony T. Brechtl, 9 Woodglen Ct., Madison, Wis. 53716

[21] Appl. No.: 595,027

[22] Filed: Jan. 31, 1996

[51] Int. Cl.[6] ..... H01R 4/66

[52] U.S. Cl. ..... 439/106; 439/103

[58] Field of Search ..... 439/103, 104, 439/106, 108, 245, 700, 824, 840, 131, 172–176

[56] References Cited

U.S. PATENT DOCUMENTS

| | | | |
|---|---|---|---|
| 1,291,443 | 1/1919 | Dorsey | 439/108 |
| 2,049,560 | 8/1936 | Ezzo | 439/695 |
| 2,897,469 | 7/1959 | Morse | 439/104 |
| 3,013,242 | 12/1961 | Terlinde | 439/269.2 |
| 3,786,392 | 1/1974 | McDaniel | 439/103 |
| 3,858,956 | 1/1975 | Garrett | 439/106 |
| 3,890,030 | 6/1975 | McDaniel | 439/103 |
| 3,984,165 | 10/1976 | Brandt | 439/108 |
| 4,078,848 | 3/1978 | Blairsdale | 439/103 |
| 4,201,431 | 5/1980 | McDonald | 439/103 |
| 4,544,216 | 10/1985 | Imhoff | 439/106 |
| 4,954,091 | 9/1990 | Marble et al. | 439/103 |
| 5,108,301 | 4/1992 | Torok | 439/263 |
| 5,213,516 | 5/1993 | Okamoto | 439/104 |

*Primary Examiner*—Neil Abrams
*Assistant Examiner*—Brian J. Biggi
*Attorney, Agent, or Firm*—DeWitt Ross & Stevens S.C.

[57] ABSTRACT

The disclosure is directed to a 3-prong grounded electrical connector which has a flexible and resilient grounding prong. The resilient grounding prong helps to maintain the connector in mating engagement with an electrical receptacle when the connector is laterally disturbed.

17 Claims, 3 Drawing Sheets

3-PRONG ELECTRICAL CONNECTOR

FIELD OF THE INVENTION

The invention relates generally to a grounded electrical connector. More specifically, the invention relates to a 3-prong grounded electrical connector having a translationally elastic and resilient grounding prong which aids in retaining the connector within an electrical receptacle.

DESCRIPTION OF THE PRIOR ART

The vast majority of modern electrical tools now include an internal grounding circuit which establishes a ground contact for the device via a third grounding cable contained within the electrical cord. This ground contact, in its most familiar form, is the cylindrical grounding prong seen in conventional 3-prong grounded electrical plugs. This ground circuit greatly increases the safety of the device by grounding the electrical motor and frame of the electrical device directly to the electricity outlet and attached structure. This greatly reduces the chance that the operator himself will serve as a ground contact and thereby be electrocuted in the event of a short circuit.

Nevertheless, the National Safety Council annually records several hundred electrical shock incidents caused by non-grounded electrical power tools and other appliances. Many of these incidents result in fatalities. While a portion of these incidents were due to appliances which were designed and built without a grounding circuit, others were caused by appliances which contained a grounding circuit, but in which the grounding circuit was compromised. As a consequence, the Occupational Safety and Health Administration (OSHA) requires that all electrical devices used in a commercial setting include a functional grounding circuit. Hefty fines are levied against individuals and companies who are found to be in violation of this administrative regulation.

However, in many industrial settings, most notably the residential and commercial construction industry, a common problem is encountered with the standard 3-prong electrical plug. As is currently standard practice, a conventional 3-prong grounded electrical plug includes two electrical leads: a "hot" lead and a "neutral" lead. These two leads are in the shape of planar blades which are disposed in corresponding parallel planes. A third lead, referred to herein as the "grounding prong," or simply "the ground," is conventionally in the form of a rigid cylindrical member. Problems arise when the 3-prong plug is displaced laterally when matingly engaged in a conventional 3-prong grounded electrical receptacle. When this happens, the hot and neutral leads are sufficiently flexible that they will normally bend within the receptacle, thereby maintaining the electrical connection to the appliance being powered. But, because the grounding prong is a rigid cylinder, this rough treatment more often than not results in the grounding prong being broken away from the plug body. This is an extremely dangerous situation because, while the tool will still function, the tool is no longer grounded. This greatly increases the chances that the tool operator will be accidentally electrocuted.

In such instances, the above-noted OSHA regulations require that the now-ungrounded plug be removed and a new plug installed. This, however, is very time consuming. Rather than halting work while the power cord is replaced or repaired, the standard, albeit unspoken, practice is to bend the hot and neutral electrical leads back into their original position and insert the plug back into the receptacle minus the grounding prong. While the tool is now ungrounded, it remains fully functional. The damaged plug, or the entire power cord, is then replaced at the end of the work day.

While the above practice is clearly unsafe (as well as subject to heavy fines by federal and state regulatory agencies), it is regularly seen in the industry as being more cost-effective than to halt production in order to fix a damaged plug. Consequently, there is a strongly felt need within the home and industrial electrical appliance market for a grounded 3-prong connector which can be laterally displaced while disposed in an electrical receptacle, without damaging the grounding circuit of the connector. Such a connector would increase the safety of electrical equipment and decrease the number fines assessed against commercial operators of such equipment for the use of ungrounded tools.

It must be noted, however, that such a connector must satisfy certain criteria in order to be acceptable to the relevant purchasing public. For instance, a standard electrical receptacle includes inward-acting leaf springs which both establish electrical contact with a plug inserted therein and which help to maintain the plug within the receptacle. Several prior art electrical plugs, described below, include outward-acting spring devices which establish a more secure frictional engagement of the plug within the receptacle. These devices, however, suffer from the decided drawback that the outward-acting forces strain the inward-acting leaf springs of the electrical receptacle. Consequently, over time, the ability of the electrical receptacle to establish a sure electrical contact with a standard plug is eroded. After repeated use, the receptacle will no longer securely engage a standard 2- or 3-prong plug due to the loss of spring action in the receptacle itself. When this occurs, the receptacle itself must be replaced.

Additionally, for safety purposes, an electrical plug should not lockingly engage the receptacle. This is dangerous because in the event that the plug must be quickly disconnected, there is the possibility that the plug will become permanently lodged within the receptacle. Should a situation arise where the electricity must be quickly disconnected, precious time may be wasted attempting to disengage a plug locked into a receptacle. This increases the risk of serious or fatal electrocution.

Several different types of electrical plugs, both of the locking variety and the non-locking variety, are described in the patent literature. For example, U.S. Pat. No. 3,013,242, to Terlinde describes a 2- or 3-prong electrical plug in which the entire body of the plug is resilient. The two blades of the plug (i.e., the hot lead and the neutral lead) are set into a roughly V-shaped body at diverging angles. To insert the plug into a receptacle, the plug body is compressed, thereby forcing the blades into corresponding parallel planes. The plug is then inserted into the receptacle and released. The natural resiliency of the plug body then forces the blades to frictionally engage the inner walls of the receptacle. The outward force of the plug body thereby "locks" the plug into the receptacle.

As noted above, however, this outward force will have a detrimental effect on the ability of the receptacle to matingly engage standard 3-prong plugs. Over time, the outward force of the plug body will erode the inward force of the electrical contacts within the receptacle. Consequently, the use of such a plug is not recommended because it will result in increased wear of the electrical receptacle.

Another locking 3-prong plug is described by Imhoff in U.S. Pat. No. 4,544,216. Here, a telescoping locking member is disposed within a U- or V-shaped grounding prong. The locking member is biased to slide telescopingly within the trough defined by the grounding prong. When the plug is inserted, the locking member is pushed through the grounding prong so that it extends from the end of the grounding prong and frictionally engages the inner wall of the electrical receptacle. A spring-biased mechanism maintains the locking member in tight frictional engagement with the receptacle. Unfortunately, as noted above, this device presents an increased danger of serious or fatal electrocution in the event that the electric current must be quickly disconnected.

Torok, U.S. Pat. No. 5,108,301, describes another type of locking electrical cord connector which includes both male and female electrical contacts. In the same fashion as a standard electrical receptacle, the female contacts of the Torok device have inward-oriented leaf spring members which frictionally engage a male contact inserted therein. In complementary fashion, the male portion of the Torok device has outward-oriented leaf spring members which aid in frictionally engaging a standard 2- or 3-prong electrical receptacle. As noted above, the outward force of the leaf spring members of the Torok device will cause increased wear on the inward-oriented leaf spring contacts of a standard electrical receptacle. This force will adversely impact the ability of the receptacle to matingly engage with a standard electrical plug.

Several other types of electrical plugs are also described in the prior art. McDaniel, U.S. Pat. Nos. 3,786,392 and 3,890,030, describes a 3-prong plug in which the grounding prong is a solid member which is mounted upon a telescoping spring embedded within the plug body. When the plug is inserted into a standard 3-prong receptacle, the spring is sufficiently stiff to force the grounding prong into the receptacle. The resiliency of the spring, however, allows the prong also to be inserted into a 2-prong receptacle. In this case, the spring allows the grounding prong to telescope into the body of the plug. It must be noted, however, that if the McDaniel plug is laterally displaced while inserted into an electrical receptacle, the grounding prong will be damaged in the same fashion as a conventional 3-prong electrical plug.

U.S. Pat. No. 2,049,560 to Ezzo describes a 2-prong ungrounded plug in which the electrical leads are "corrugated" blades. The blades are not, however, resilient or spring-like. And, as noted above, the increased friction caused by the corrugated blades will result in a premature aging of the electrical receptacle into which this type of plug is inserted.

Garrett, U.S. Pat. No. 3,858,956, describes a 3-prong electrical plug in which the grounding prong is a longitudinally segmented cylindrical member having a number of raised radial ridges along its length. The longitudinal slits define a plurality of "somewhat" flexible segments which impart some "give" to the grounding prong. However, these segments are not resilient and will readily deform if laterally displaced. The raised radial ridges function to increase the frictional engagement of the plug within a receptacle.

None of the above references, taken alone or in any combination, describe the 3-prong electrical connector disclosed and claimed herein.

SUMMARY OF THE INVENTION

It is a principal aim and object of the present invention to provide a 3-prong grounded electrical connector which operationally maintains a grounding prong within an electrical receptacle even when the connector is laterally displaced within the electrical receptacle.

It is a further aim of the present invention to provide a 3-prong electrical connector in which the grounding prong is a resilient and elastic member.

Yet another aim of the present invention is to provide a 3-prong grounded electrical connector in which the grounding prong is a coil spring which is sufficiently stiff to maintain electrical contact with the grounding circuit of an electrical receptacle, yet sufficiently flexible and resilient to allow lateral and translational displacement of the electrical connector without damaging the grounding plug.

A still further aim of the present invention is to provide a 3-prong grounded electrical connector which decreases the likelihood of electric shock to the user of an electrical appliance by including a resilient and flexible grounding prong which maintains electrical contact with an electrical receptacle even when laterally displaced.

Yet a further aim of the present invention is to provide a 3-prong electrical plug adaptor which allows a conventional 3-prong electrical plug to be converted into a 3-prong electrical connector of the present invention having a flexible and resilient grounding prong.

In light of the above discussion, the present invention is drawn to a 3-prong grounded electrical connector which comprises a body of electrically-insulated material and a first electrically-conductive lead secured in the body and extending therefrom, the first lead dimensioned and configured to operationally engage a hot conductor of a 3-conductor electrical cord. The connector further includes a second electrically-conductive lead secured in the body and extending therefrom, the second lead dimensioned and configured to operationally engage a neutral conductor of the 3-conductor cord; and an electrically-conductive grounding prong secured in the body and extending therefrom, the grounding prong dimensioned and configured to operationally engage a ground conductor of the 3-conductor cord, and further wherein the grounding prong is a translationally elastic and resilient member.

The present invention is also directed to a 3-prong grounded electrical connector comprising: a body of electrically-insulated material; a female electric contact disposed within the body; a male electric contact disposed within the body, the male electric contact comprising a first electrically-conductive lead secured in the body and extending therefrom: a second electrically-conductive lead secured in the body and extending therefrom; and an electrically-conductive grounding prong secured in the body and extending therefrom, and further wherein said grounding prong is a translationally elastic and resilient member; and means for electrically connecting the male electric contact to the female electric contact.

The present invention is further drawn to a 3-prong grounded electrical connector in combination with a 3-conductor electrical cord, the connector comprising: a body of electrically-insulated material; a first and a second electrically-conductive lead, the first and second leads secured in the body and extending therefrom, the first and second leads electrically connected at a point within said body to a hot conductor and a neutral conductor of the 3-conductor electrical cord, respectively; and an electrically-conductive grounding prong secured in the body and extending therefrom, the grounding prong electrically connected at a point within the body to a third conductor of the 3-conductor electrical cord which is to be grounded, wherein the grounding prong is a translationally elastic and resilient member.

These and other aims, objects, and advantages of the present invention will become clear upon a complete reading of the Detailed Description and attached claims, below.

DETAILED DESCRIPTION OF THE INVENTION

Figure 1:
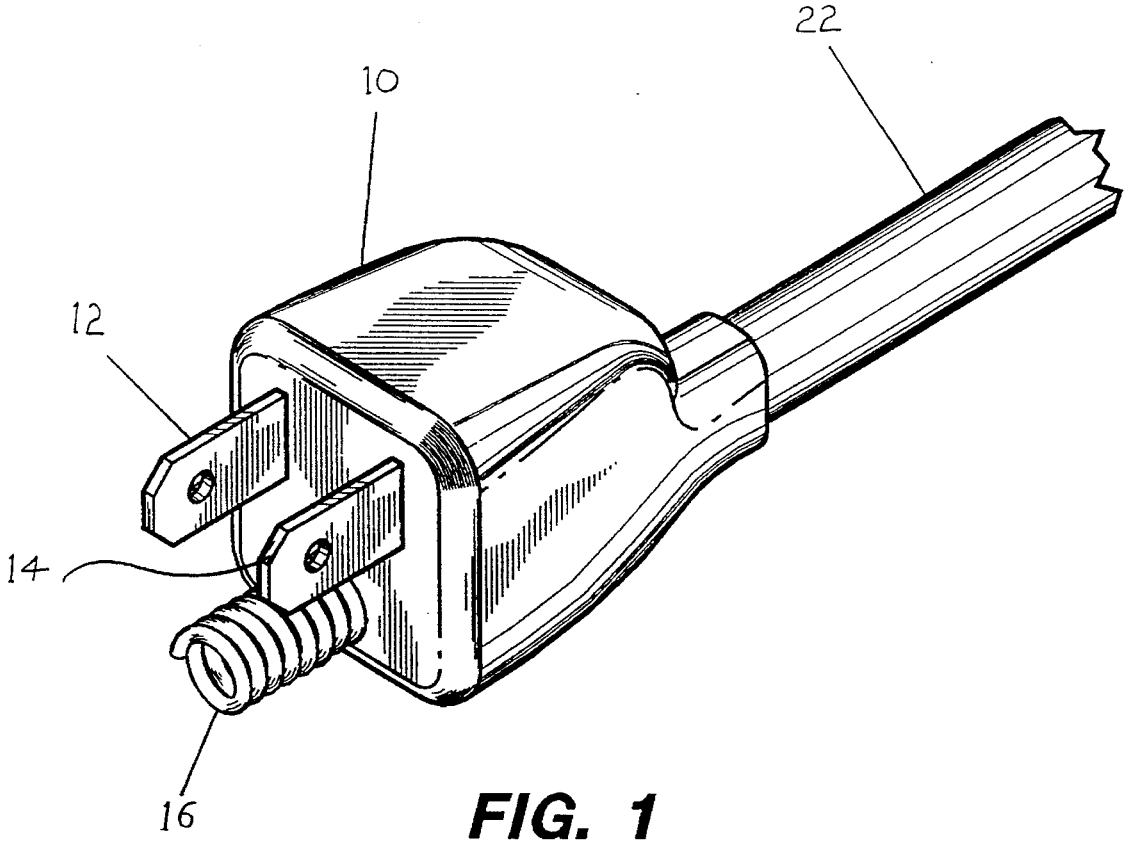
FIG. 1 depicts a perspective view of a 180 degree, 3-prong electrical connector according to the present invention.

Identical reference numerals are used throughout the drawing figures to indicate identical or similar features of the claimed electrical connector.

Referring now to FIG. 1, which is a perspective view of a 3-prong grounded electrical connector according to the present invention, the connector includes a body of electrically-insulated material 10. The body 10 can be fabricated from any type of insulated material, such as rubber, polyurethane, polyvinyl chloride, or any number of other well known thermosetting or thermoplastic materials. So long as the body material will shield an operator from electric shock, the material is not critical to the operation of the electrical connector.

Figure 2:
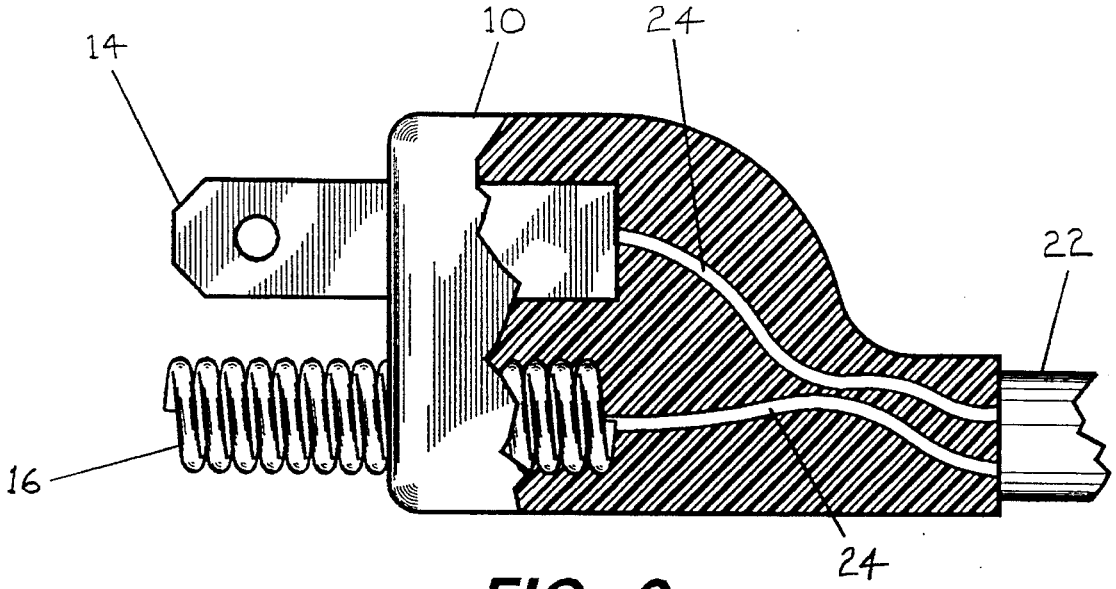
FIG. 2 depicts a side elevational view in partial cut-away of a 3-prong electrical connector according to the present invention.

Securely fastened or embedded within the body 10 is a first electrically-conductive lead 12 and a second electrically-conductive lead 14 which extend from the body 10. As shown in FIG. 2, which is a front elevational, partially cut-away view of the connector shown in FIG. 1, both the first lead 12 (hidden from view in FIG. 2) and the second lead 14 are dimensioned and configured to operationally engage a hot conductor and a neutral conductor of 3-conductor cord 22 by means for conducting electricity 24. Such means for conducting electricity include conductive wires, clips, fasteners, and the like. Such means for conducting electricity can be either fixed or releasible.

The 3-conductor cord 22 shown in the figures is a conventional cord for conducting electricity to an electrically powered apparatus which includes a "hot" conductor, and "neutral" conductor, and a ground circuit. Such cords are conventional and well known in the art.

An electrically-conductive grounding prong 16 is also securely fastened or embedded in body 10 and extends therefrom. Also as shown in FIG. 2, the grounding prong 10 is dimensioned and configured to operationally engage a ground conductor of the 3-conductor cord 22 by means for conducting electricity 24. Of particular note in the present invention is that the grounding prong 16 is a translationally elastic and resilient member.

Figure 3:
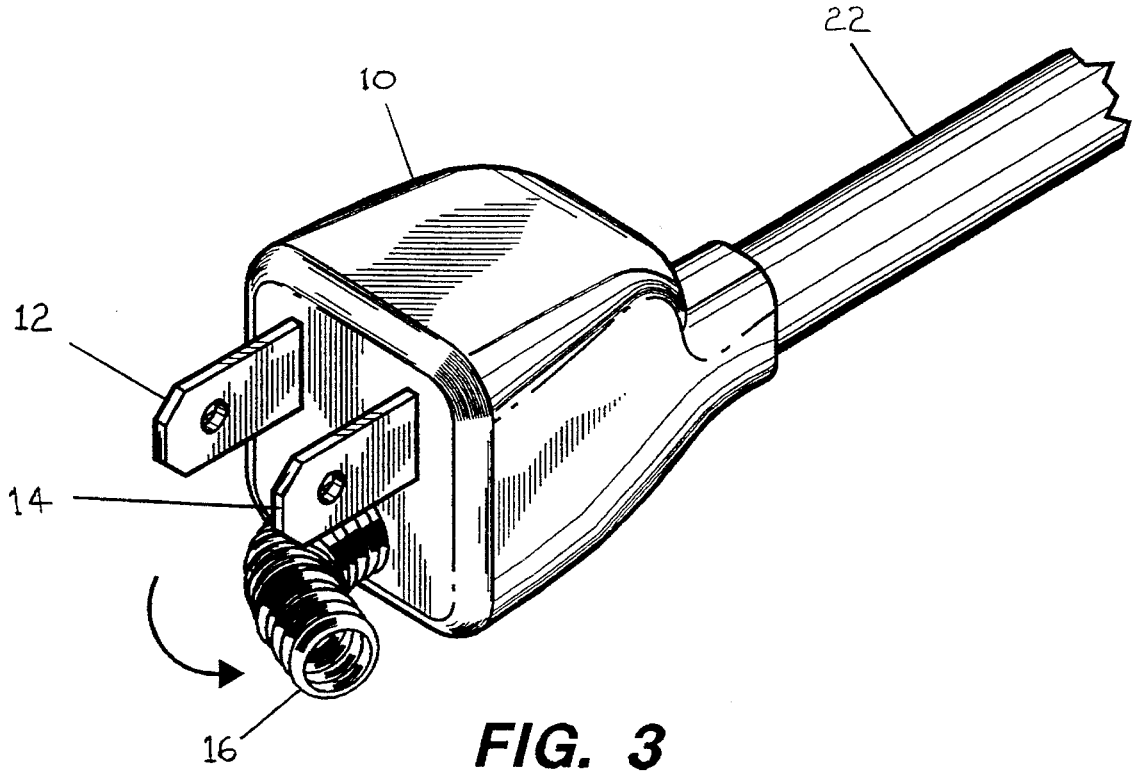
FIG. 3 depicts a perspective view of a 3-prong electrical connector according to the present invention wherein the grounding prong is translationally displaced by a lateral force.

As shown throughout the drawing figures, the grounding prong 16 is preferably a cylindrical coil spring. The grounding prong 16 is sufficiently stiff so that when it is inserted into an electrical receptacle, it will function in the same fashion as a prior art, inflexible, monolithic grounding prong. However, when the body 10 is laterally or translationally strained when disposed within an electrical receptacle, the grounding prong 16 will reversibly deform to maintain contact with a grounding contact of the electrical circuit. Such resilient deformation of the grounding prong 16 is shown in FIG. 3.

While depicted throughout the figures as a coil spring, the grounding prong of the present invention can be any suitably flexible and resilient electrically-conductive material in any shape, dimension, or configuration. As used herein, the term "resilient" has its standard, accepted denotation, i.e. the capability of a strained body to recover its size and shape after deformation. (Webster's Ninth Collegiate Dictionary, Merriam-Webster, Inc., Springfield, Mass.) For instance, the grounding prong 16 may comprise several segmented members joined by one or more flexible, resilient, and electrically-conductive joints. Or, the grounding prong 16 may comprise a unitary, monolithic member of a suitably electrically-conductive, flexible, and resilient polymeric material.

The first and second leads and grounding prong of the present invention may be fabricated from any suitable electrical conductor. Such conductors preferably are metals such as silver, copy, iron, nickel, aluminum, alloys of the same, and the like.

In a preferred embodiment of the present invention, the first lead 12 and the second lead 14, where they extend from the body 10, are elongated planar members having flat surfaces. As shown throughout the figures, the preferred embodiment of the present invention has the flat surfaces of the first lead 12 and the flat surfaces of the second lead 14 oriented in corresponding parallel planes. This is best illustrated by the superimposition of the first and second leads in the front elevational views of FIGS. 2 and 4.

It is also preferred that the grounding prong 16, where it extends from the body 10, is disposed in a plane equidistant from and non-collinear with the corresponding parallel planes defined by the first and second leads. This is best shown in FIG. 1. It is still more preferable that the first lead 12, the second lead 14, and the grounding prong 16, where they extend from the body 10, are dimensioned and configured to matingly and releasibly engage a conventional 110 Volt, 3-slot grounded electrical receptacle such as those used throughout the United States of America. As is now becoming standard practice in the United States, the first lead and the second lead may be polarized. Here, one of the leads is made slightly larger than the other to ensure that the connector can be inserted into a receptacle in only one orientation.

Figure 4:
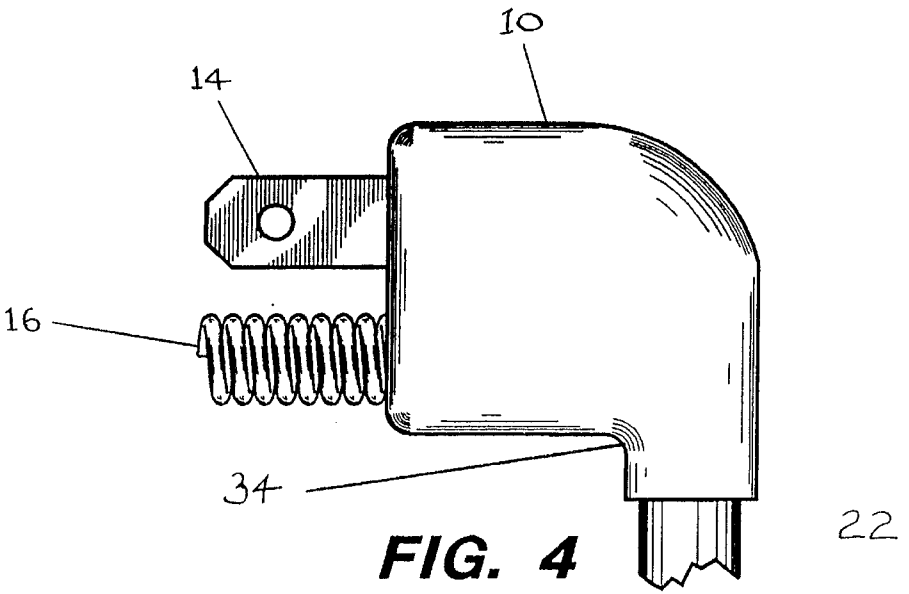
FIG. 4 depicts a side elevational view of a 90 degree, 3-prong electrical connector according to the present invention.

As shown in FIG. 1, the connector body 10 of the present invention and the 3-conductor electrical cord 22 to which it is attached are oriented in a roughly straight 180 degree fashion. The electrical connector of the present invention may also be combined with a 3-conductor electrical cord in a roughly 90 degree joint 34 as shown in FIG. 4. In all other respects, the embodiments depicted in FIGS. 1 and 4 are identical.

As shown in FIGS. 1 through 4, the electrical connector of the present invention is operationally connected to a conventional 3-conductor electrical cord 22. However, the present invention may also take the form of an electrical connector which functions as an adapter to convert a conventional 3-prong electrical connector into a connector according to the present invention. In this embodiment, the invention comprises a female electric contact disposed within a body which is electrically connected to a male electrical contact extending from the body and having a flexible and resilient grounding prong.

Figure 5:
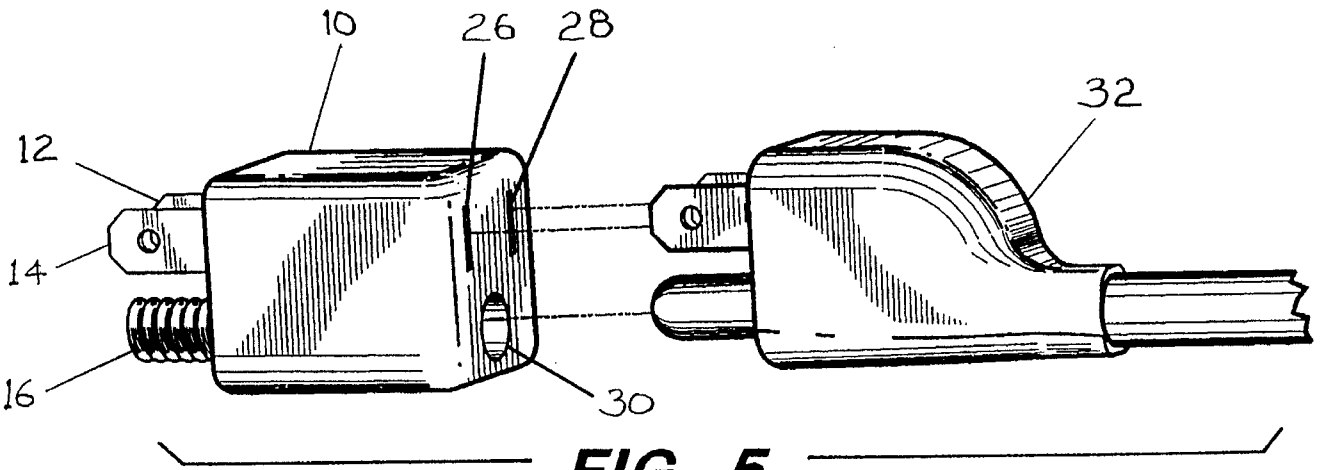
FIG. 5 depicts a perspective view of a 3-prong electrical connector adapter according to the present invention in operational relationship with a prior art 3-prong electrical plug.

Referring now to FIG. 5, this second embodiment of the present invention includes a 3-prong grounded electrical connector comprising a body of electrically-insulated material 10 which has a female electric contact disposed within the body. As shown in FIG. 5, the female electric contact comprises a first planar slot 26, and second planar slot 28, and a cylindrical slot 30. A preferred embodiment, depicted in FIG. 5, has the female electrical contact dimensioned and configured to receive a pair of electrical leads and a grounding prong of a cooperating male connector 32 of another electrical appliance.

The embodiment shown in FIG. 5 also includes a male electric contact disposed within the body, the male electric contact comprising a first electrically-conductive lead 12, a second electrically-conductive lead 14, and an electrically-conductive grounding prong 16 securely fastened or imbedded in the body 10 and extending therefrom. The first lead 12 and the second lead 14 are the same as described above. Also as described above, the grounding prong 16 is a translationally elastic and resilient member, depicted in FIG. 5 as a coil spring.

The first planar slot 26, second planar slot 28, and a cylindrical slot 30 of the female electrical contact are operationally connected to the first electrically-conductive lead 12, the second electrically-conductive lead 14, and the electrically-conductive grounding prong 16, respectively, of the male electrical contact via means for conducting electricity 24 as shown in FIG. 2.

The most preferred mode of the second embodiment is where the first planar slot 26, and the second planar slot 28, and the cylindrical slot 30, respectively, are dimensioned and configured to receive a pair of electrical leads and a grounding prong of the conventional 110 V, 3-prong male connector 32 used throughout the United States. In analogous fashion, it is preferred that the first lead 12, the second lead 14, and the grounding prong 16, where they extend from the body 10, as shown in FIG. 5, are dimensioned and configured to matingly and releasibly engage the conventional 110 Volt, 3-slot grounded electrical receptacle used throughout the United States.

The present invention is not limited to the embodiments explicitly described above, but includes all such modifications, extensions, and variations thereof which fall within the scope of the attached claims.

What is claimed is:

1. A 3-prong grounded electrical connector comprising:

a body of electrically-insulated material;

a first electrically-conductive lead secured in said body and extending therefrom, said first lead dimensioned and configured to operationally engage a hot conductor of a 3-conductor electrical cord;

a second electrically-conductive lead secured in said body and extending therefrom, said second lead dimensioned and configured to operationally engage a neutral conductor of the 3-conductor cord; and an electrically-conductive grounding prong secured in said body and extending therefrom, said grounding prong dimensioned and configured to operationally engage a ground conductor of the 3-conductor cord, and further wherein where said grounding prong extends from said body said grounding prong is a coil spring.

2. The electrical connector according to claim 1, wherein said grounding prong is a cylindrical coil spring.

3. The electrical connector according to claim 1, wherein said first lead and said second lead, where they extend from said body, are elongated planar members having flat surfaces, the flat surfaces of said first lead and the flat surfaces of said second lead disposed in corresponding parallel planes.

4. The electrical connector according to claim 3, wherein said grounding prong, where it extends from said body, is disposed in a plane equidistant from and non-collinear with the corresponding parallel planes defined by said first and second leads.

5. The electrical connector according to claim 4, wherein said first lead, said second lead, and said grounding prong, where they extend from said body, are dimensioned and configured to matingly and releasibly engage a conventional 110 Volt, 3-slot grounded electrical receptacle.

6. The electrical connector according to claim 1, wherein said first lead, said second lead, and said grounding prong, where they are secured in said body, are dimensioned and configured to releasibly and matingly engage a pair of electrical leads and a grounding prong, respectively, of a cooperating male connector of another electrical appliance.

7. A 3-prong grounded electrical connector comprising:

a body of electrically-insulated material;

a female electric contact disposed within said body;

a male electric contact disposed within said body, said male electric contact comprising a first electrically-conductive lead secured in said body and extending therefrom; a second electrically-conductive lead secured in said body and extending therefrom; and an electrically-conductive grounding prong secured in said body and extending therefrom, and further wherein where said grounding prong extends from said body said grounding prong is coil spring; and means for electrically connecting said male electric contact to said female electric contact.

8. The electrical connector according to claim 7, wherein said female contact comprises three receptacles for receiving a pair of electrical leads and a grounding prong of a cooperating male connector of another electrical appliance.

9. The electrical connector according to claim 8, wherein said three receptacles are a first and a second planar slot disposed in said body and a cylindrical slot disposed in said body, and wherein said first and second planar slots and said cylindrical slot are electrically connected to said first electrically-conductive lead, said second electrically-conductive lead, and said electrically-conductive grounding prong, respectively.

10. The electrical connector according to claim 9, wherein said grounding prong is a cylindrical coil spring.

11. The electrical connector according to claim 7, wherein said first lead and said second lead are elongated planar members having flat surfaces, the flat surfaces of said first lead and the flat surfaces of said second lead disposed in corresponding parallel planes.

12. The electrical connector according to claim 11, wherein said grounding prong is disposed in a plane equidistant from and non-collinear with the corresponding parallel planes defined by said first and second leads.

13. The electrical connector according to claim 12, wherein said first lead, said second lead, and said grounding prong are dimensioned and configured to matingly and releasibly engage a conventional 110 Volt, 3-slot grounded electrical receptacle and wherein said female contact is dimensioned and configured to matingly and releasibly engage a conventional 110 volt, 3-slot cooperating male connector of another electrical appliance.

14. A 3-prong grounded electrical connector in combination with a 3-conductor electrical cord, said connector comprising:

a body of electrically-insulated material;

a first and a second electrically-conductive lead; said first and second leads secured in said body and extending therefrom, said first and second leads electrically connected at a point within said body to a hot conductor and a neutral conductor of said 3-conductor electrical cord, respectively; and an electrically-conductive grounding prong secured in said body and extending therefrom, said grounding prong electrically connected at a point within said body to a third conductor of said 3-conductor electrical cord which is to be grounded, wherein where said grounding prong extends from said body said grounding prong is a coil spring.

15. The electrical connector according to claim 14, wherein said first lead and said second lead, where they extend from said body, are elongated planar members having flat surfaces, the flat surfaces of said first lead and the flat surfaces of said second lead disposed in corresponding parallel planes.

16. The electrical connector according to claim 15, wherein said grounding prong, where it extends from said body, is disposed in a plane equidistant from and non-collinear with the corresponding parallel planes defined by said first and second leads.

17. The electrical connector according to claim 16, wherein said first lead, said second lead, and said grounding prong, where they extend from said body, are dimensioned and configured to matingly and releasibly engage a conventional 110 Volt, 3-slot grounded electrical receptacle.

* * * * *